US006270175B1

(12) United States Patent
Sfeir

(10) Patent No.: US 6,270,175 B1
(45) Date of Patent: Aug. 7, 2001

(54) FOOT DOOR OPENER ATTACHMENT FOR A REFRIGERATOR

(76) Inventor: Antoine Sfeir, 529 W. Olive St., Ingelwood, CA (US) 90301

( * ) Notice: Subject to any disclaimer, the term of this patent is extended or adjusted under 35 U.S.C. 154(b) by 0 days.

(21) Appl. No.: 09/502,300

(22) Filed: Feb. 11, 2000

(51) Int. Cl.[7] ..... A47B 95/02
(52) U.S. Cl. ..... 312/319.9; 280/291
(58) Field of Search ..... 312/319.9, 324; 292/255, 336.3; 49/324, 278, 263

(56) References Cited

U.S. PATENT DOCUMENTS

| | | | | |
|---|---|---|---|---|
| D. 243,447 | | 2/1977 | Smith, III et al. . | |
| 3,012,837 | | 12/1961 | Morrissey, Jr. . | |
| 4,911,508 | * | 3/1990 | Tillman | 312/319.9 |
| 5,193,863 | | 3/1993 | Mcbain . | |
| 5,469,661 | | 11/1995 | Finkelstein et al. . | |
| 5,622,416 | | 4/1997 | Rainey et al. . | |
| 6,070,897 | * | 6/2000 | Hsieh et al. | 280/291 |

* cited by examiner

*Primary Examiner*—Peter M. Cuomo
*Assistant Examiner*—Michael J. Fisher

(57) ABSTRACT

A foot door opener attachment for a refrigerator for easily and conveniently opening the door of a refrigerator with little effort. The foot door opener attachment for a refrigerator includes a mounting bracket being adapted to securely attach to a side wall of the refrigerator near where the door to the refrigerator can be opened; and also includes a spring-loaded lever being pivotally mounted at a central portion thereof to the mounting bracket and having a second end, a first end, and a spring member being securely attached to the mounting bracket and to the first end to bias the first end of the spring-loaded lever out of contact with the door of the refrigerator; and further includes a foot support member being securely mounted to the second end of the spring-loaded lever; and also includes a door opening member securely attached to the first end of the spring-loaded lever.

9 Claims, 2 Drawing Sheets

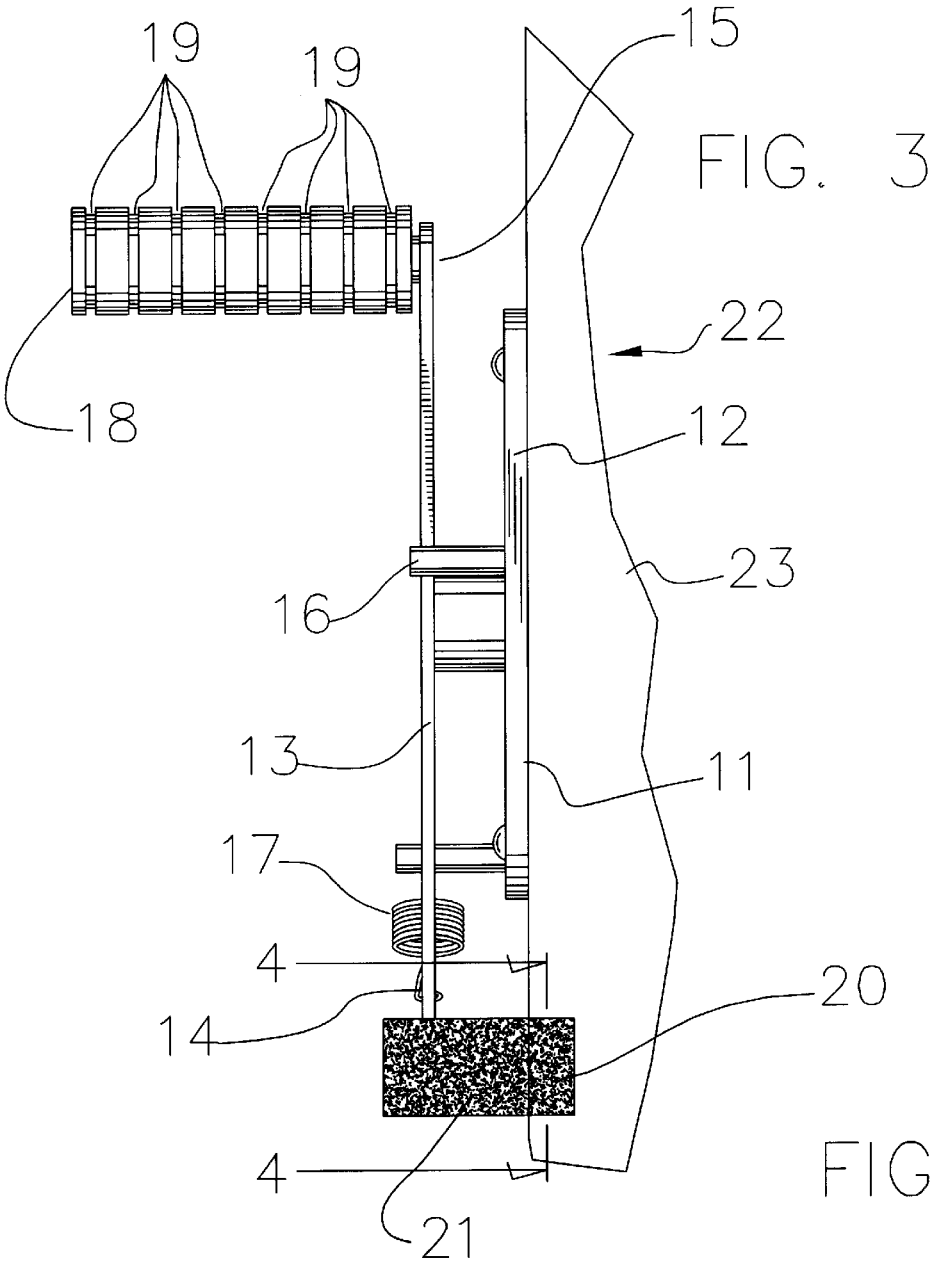
FIG. 3
FIG. 4
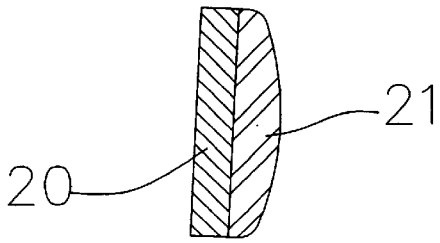

FOOT DOOR OPENER ATTACHMENT FOR A REFRIGERATOR

BACKGROUND OF THE INVENTION

1. Field of the Invention

The present invention relates to a refrigerator foot door opener and more particularly pertains to a new foot door opener attachment for a refrigerator for easily and conveniently opening the door of a refrigerator with little effort.

2. Description of the Prior Art

The use of refrigerator foot door opener is known in the prior art. More specifically, refrigerator foot door opener heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,012,837; U.S. Pat. No. 5,193,863; U.S. Pat. No. 5,622,416; U.S. Pat. No. 4,911,508; U.S. Pat. No. 5,469,661; and U.S. Pat. No. Des. 243,447.

While these devices fulfill their respective, particular objectives and requirements, the aforementioned patents do not disclose a new foot door opener attachment for a refrigerator. The inventive device includes a mounting bracket being adapted to securely attach to a side wall of the refrigerator near where the door to the refrigerator can be opened; and also includes a spring-loaded lever being pivotally mounted at a central portion thereof to the mounting bracket and having a second end, a first end, and a spring member being securely attached to the mounting bracket and to the first end to bias the first end of the spring-loaded lever out of contact with the door of the refrigerator; and further includes a foot support member being securely mounted to the second end of the spring-loaded lever; and also includes a door opening member securely attached to the first end of the spring-loaded lever.

In these respects, the foot door opener attachment for a refrigerator according to the present invention substantially departs from the conventional concepts and designs of the prior art, and in so doing provides an apparatus primarily developed for the purpose of easily and conveniently opening the door of a refrigerator with little effort.

SUMMARY OF THE INVENTION

In view of the foregoing disadvantages inherent in the known types of refrigerator foot door opener now present in the prior art, the present invention provides a new foot door opener attachment for a refrigerator construction wherein the same can be utilized for easily and conveniently opening the door of a refrigerator with little effort.

The general purpose of the present invention, which will be described subsequently in greater detail, is to provide a new foot door opener attachment for a refrigerator which has many of the advantages of the refrigerator foot door opener mentioned heretofore and many novel features that result in a new foot door opener attachment for a refrigerator which is not anticipated, rendered obvious, suggested, or even implied by any of the prior art refrigerator foot door opener, either alone or in any combination thereof.

To attain this, the present invention generally comprises a mounting bracket being adapted to securely attach to a side wall of the refrigerator near where the door to the refrigerator can be opened; and also includes a spring-loaded lever being pivotally mounted at a central portion thereof to the mounting bracket and having a second end, a first end, and a spring member being securely attached to the mounting bracket and to the first end to bias the first end of the spring-loaded lever out of contact with the door of the refrigerator; and further includes a foot support member being securely mounted to the second end of the spring-loaded lever; and also includes a door opening member securely attached to the first end of the spring-loaded lever.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot door opener attachment for a refrigerator which has many of the advantages of the refrigerator foot door opener mentioned heretofore and many novel features that result in a new foot door opener attachment for a refrigerator which is not anticipated, rendered obvious, suggested, or even implied by any of the prior art refrigerator foot door opener, either alone or in any combination thereof.

It is another object of the present invention to provide a new foot door opener attachment for a refrigerator which may be easily and efficiently manufactured and marketed.

It is a further object of the present invention to provide a new foot door opener attachment for a refrigerator which is of a durable and reliable construction.

An even further object of the present invention is to provide a new foot door opener attachment for a refrigerator which is susceptible of a low cost of manufacture with regard to both materials and labor, and which accordingly is then susceptible of low prices of sale to the consuming public, thereby making such foot door opener attachment for a refrigerator economically available to the buying public.

Still yet another object of the present invention is to provide a new foot door opener attachment for a refrigerator which provides in the apparatuses and methods of the prior art some of the advantages thereof, while simultaneously overcoming some of the disadvantages normally associated therewith.

Still another object of the present invention is to provide a new foot door opener attachment for a refrigerator for easily and conveniently opening the door of a refrigerator with little effort.

Yet another object of the present invention is to provide a new foot door opener attachment for a refrigerator which includes a mounting bracket being adapted to securely attach to a side wall of the refrigerator near where the door to the refrigerator can be opened; and also includes a spring-loaded lever being pivotally mounted at a central portion thereof to the mounting bracket and having a second end, a first end, and a spring member being securely attached to the mounting bracket and to the first end to bias the first end of the spring-loaded lever out of contact with the door of the refrigerator; and further includes a foot support member being securely mounted to the second end of the spring-loaded lever; and also includes a door opening member securely attached to the first end of the spring-loaded lever.

Still yet another object of the present invention is to provide a new foot door opener attachment for a refrigerator that allows a user having one's hands full to still easily and conveniently open the door of the refrigerator.

Even still another object of the present invention is to provide a new foot door opener attachment for a refrigerator that makes it easier for the people less able to open a door of the refrigerator to actually open the door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the present invention.

FIG. 4 is a detail veiw of the door opening member of the present invention taken along line 4—4 of FIG. 3.

DESCRIPTION OF THE PREFERRED EMBODIMENT

Figure 1:
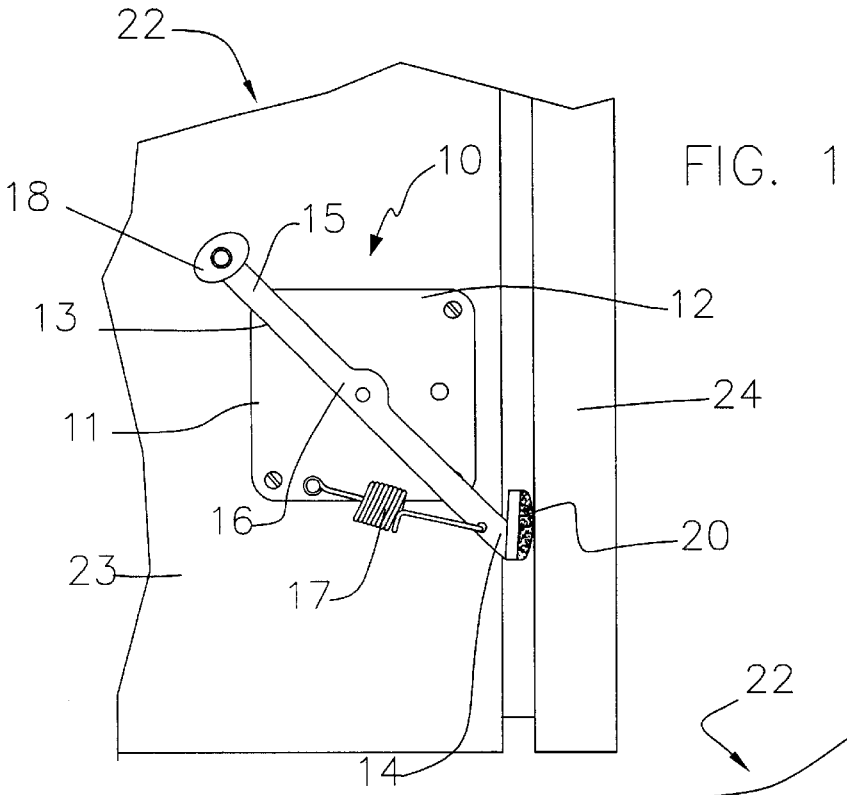
FIG. 1 is a side elevational view of a new foot door opener attachment for a refrigerator according to the present invention and being mooed to a refrigerator.
Figure 2:
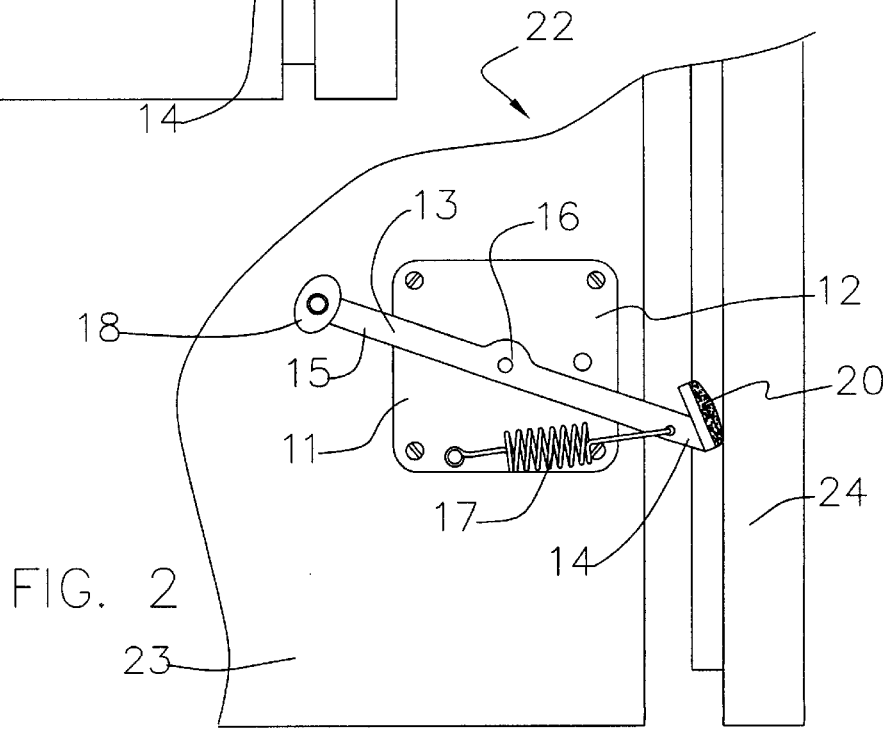
FIG. 2 is a side elevational view of the present invention being used.

With reference now to the drawings, and in particular to FIGS. 1 through 4 thereof, a new foot door opener attachment for a refrigerator embodying the principles and concepts of the present invention and generally designated by the reference numeral 10 will be described.

As best illustrated in FIGS. 1 through 4, the foot door opener attachment for a refrigerator 10 generally comprises a mounting bracket 11 which is adapted to be securely attached with fasteners near a bottom and at a front of a side wall 23 of a refrigerator 22 where a door 24 of the refrigerator 22 can be opened. The mounting bracket 11 is a plate-like member 12 having a back side which is adapted to being flush and securely attached to the side wall 23 of the refrigerator 23. A spring-loaded lever 13 is pivotally and conventionally attached with a pivot member to the mounting bracket 11 and has a central portion 16, a first end 14, and a second end 15 with the spring-loaded lever 13 being pivotally attached at its the central portion 16 to a front side of the mounting bracket 11. The first end 14 of the spring-loaded lever 13 is movably disposed below a pivot point of the spring-loaded lever 13 and is adapted to be disposed in contactable relationship with the door 24 of the refrigerator 22. The second end 15 of the spring-loaded lever 13 is movably disposed above the pivot point of the spring-loaded lever 13. The spring-loaded lever 13 includes a spring member 17 having a first end securely attached near a bottom of the plate-like member 12, and further having a second end securely attached to near the first end 14 of the spring-loaded lever 13. The spring member 17 is adapted to bias the first end 14 of the spring-loaded lever 13 out of contact with the door 24 of the refrigerator 22. A foot support member 18 is securely and conventionally attached to the second end 15 of the spring-loaded lever 13. The foot support member 18 is essentially a cylindrical member having a plurality of grooves 19 spaced apart and extending about the circumference of the cylindrical member for providing a gripping surface for a user's foot. A door opening member 20 is securely and conventionally mounted to the first end 14 of the spring-loaded lever 13 and is essentially a plate having a front side and a padded member 21 securely attached to the front side and being adapted to urge the door 24 of the refrigerator 22 open upon being moved by a user pressing down upon the foot support member 18.

In use, the user can open the door 24 of a refrigerator 22 by pressing down on the foot support member 18 which pivots the first end 14 of the spring-loaded lever 13 into engagement with the door 24 and with the door opening member 20 urging the refrigerator door 24 open. Once the refrigerator door 24 is opened the user can take one's foot off the foot support member 18; whereupon, the spring member 17 urges the first end 14 of the spring-loaded member 13 out of contact with the door 24 upon the door 24 being closed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot door opening attachment for a refrigerator comprising:

a mounting bracket which is adapted to be securely attached near a bottom and at a front of a side wall of a refrigerator where a door of the refrigerator is opened;

a spring-loaded lever being pivotally attached to said mounting bracket and having a central portion, a first end, and a second end, said spring-loaded lever being pivotally attached to said mounting bracket at a pivot located on the central portion of the spring loaded-lever such that said first and second ends are pivotable about the central portion;

a foot support member being attached to said second end of said spring-loaded lever;

a door contacting member being attached to the first end of said spring-loaded lever for contacting the door of the refrigerator when a user presses a foot against the foot support member to release the magnetic seal on the door; and a spring member having a first end attached to said plate-like member and a second end attached to said spring-loaded lever at a location spaced from said pivot.

2. A foot door opening attachment for a refrigerator as described in claim 1, wherein said mounting bracket is a plate-like member having a back side which is adapted to being securely attached to the side wall of the refrigerator.

3. A foot door opening attachment for a refrigerator as described in claim 2, wherein said spring-loaded lever is pivotally attached at its said central portion to a front side of said mounting bracket.

4. A foot door opening attachment for a refrigerator as described in claim 3, wherein said first end of said spring-loaded lever is movably disposed below a pivot point of said spring-loaded lever and is adapted to be disposed in contactable relationship with the door of the refrigerator.

5. A foot door opening attachment for a refrigerator as described in claim 4, wherein said second end of said spring-loaded lever is movably disposed above the pivot point of said spring-loaded lever.

6. A foot door opening attachment for a refrigerator as described in claim 5, wherein said spring-loaded lever includes a spring member having a first end securely attached near a bottom of said plate-like member, and further having a second end securely attached to near said first end of said spring-loaded lever, said spring member being adapted to bias said first end of said spring-loaded lever out of contact with the door of the refrigerator.

7. A foot door opening attachment for a refrigerator as described in claim 1, wherein said foot support member is essentially a cylindrical member having a plurality of grooves spaced apart and extending about the circumference of said cylindrical member for providing a gripping surface for a user's foot.

8. A foot door opening attachment for a refrigerator as described in claim 1, wherein said door contacting member further includes a door opening member securely mounted to said first end of said spring-loaded lever and being essentially a plate having a front side and a padded member securely attached to said front side of said plate.

9. A foot door opening attachment for a refrigerator comprising:

a mounting bracket which is adapted to be securely attached near a bottom and at a front of a side wall of a refrigerator where a door of the refrigerator is opened, said mounting bracket being a plate-like member having a back side which is adapted to being securely attached to the side wall of the refrigerator;

a spring-loaded lever being pivotally attached to said mounting bracket and having a central portion, a first end, and a second end, said spring-loaded lever being pivotally attached to said mounting bracket at a pivot located on the central portion of the spring loaded-lever such that said first and second ends are pivotable about the central portion;

a foot support member being securely attached to said second end of said spring-loaded lever, said foot support member being essentially a cylindrical member having a plurality of grooves spaced apart and extending about the circumference of said cylindrical member for providing a gripping surface for a user's foot; and a door contacting member being attached to the first end of said spring-loaded lever for contacting the door of the refrigerator when a user presses a foot against the foot support member to release the magnetic seal on the door; and a spring member having a first end attached to said plate-like member and a second end attached to said spring-loaded lever at a location spaced from said pivot;

wherein said door contacting member comprises a door opening member being securely mounted to said first end of said spring-loaded lever, wherein said door opening member is essentially a plate having a front side and a padded member securely attached to said front side of said plate and being adapted to urge the door of the refrigerator open upon being moved by a user pressing down upon said foot support member.

* * * * *